United States Patent [19]

Ohno et al.

[11] 4,284,431

[45] Aug. 18, 1981

[54] METHOD FOR THE PRODUCTION OF SINTERED POWDER FERROUS METAL PREFORM

[75] Inventors: Eiji Ohno, Tokyo; Kazuo Chikugo, Hiratsuka, both of Japan

[73] Assignee: Kabushiki Kaisha Komatsu Seisakusho, Tokyo, Japan

[21] Appl. No.: 73,377

[22] Filed: Sep. 7, 1979

Related U.S. Application Data

[62] Division of Ser. No. 931,320, Aug. 7, 1978, Pat. No. 4,202,689.

[30] Foreign Application Priority Data

Aug. 5, 1977 [JP] Japan ..... 52-93375

[51] Int. Cl.[3] ..... B22F 3/00

[52] U.S. Cl. ..... 75/212; 75/211

[58] Field of Search ..... 75/200, 211, 212

[56] References Cited

U.S. PATENT DOCUMENTS

| | | | |
|---|---|---|---|
| Re. 25,661 | 10/1964 | Less et al. | 427/221 |
| 3,148,056 | 9/1964 | Brodie et al. | 75/212 |
| 3,264,073 | 8/1966 | Schmitt | 75/212 |
| 3,313,621 | 4/1967 | Mott | 75/212 |
| 3,625,673 | 12/1971 | Lindquist | 75/211 |
| 3,811,878 | 5/1974 | Chao et al. | 75/211 |
| 3,989,518 | 11/1976 | Rueckl | 75/211 |

*Primary Examiner*—Brooks H. Hunt

*Attorney, Agent, or Firm*—Wegner & Bretschneider

[57] ABSTRACT

A method for the production of sintered powder metal preform employing a novel reduction step. As-water-atomized ferrous metal particles are coated by phenol resins by adding said phenol resins to said ferrous metal particles after heating the metal particles to about 130° C. to 150° C. Resin coated ferrous metal particles are then filled in a mold and compacted under high pressure to produce a compacted green preform sufficient to ensure adequate strength for handling after pressing. The green preform is then heated to a reduction temperature within the range of about 1100° C. to 1250° C. for a time sufficient to achieve reduction of said green preform.

5 Claims, 9 Drawing Figures

NO. 66 Powders

| | Phenol Resin | Effective Carbon Content (%) | Sintering Temperature(°C) | Sintering Time(min) |
|---|---|---|---|---|
| ⊕ | BP 80 | 20 % | 1200 °C | 120 |
| ⊕ | 〃 | 〃 | 1150 °C | 〃 |
| ○ | BP 30 | 30 % | 〃 | 〃 |
| • | SP 850 | 40 % | 〃 | 〃 |

(Sintered in $N_2$ Current(1000l/H) at 1200°C for 120min NO. 66 Powders)

METHOD FOR THE PRODUCTION OF SINTERED POWDER FERROUS METAL PREFORM

This is a Division of application Ser. No. 931,320 filed Aug. 7, 1978 now U.S. Pat. No. 4,202,689.

BACKGROUND OF THE INVENTION

This invention relates to a production of powder metal preforms and in particular to a reduction sintering method of as-atomized ferrous metal powders.

There are a number of different methods by which metal powders useful in the production of powder metal compacts, have been produced. These methods include, for example, electrolytic processes, ore reduction processes and water atomization processes. The latter process has recently come to the forefront, especially in the production of ferrous metal powders, since the process is generally more economical and produces particles of a shape and density which provide a powder compact with enhanced physical properties. When producing finely divided ferrous metal particles by water atomization, oxide films are formed on the surface thereof due to the reaction with oxygen. In order to produce powders useful for further compacting, the atomized powders must first be annealed in a reducing atmosphere such as hydrogen to soften the powders and reduce the oxide surface thereof.

The reduction process is generally conducted in a hydrogen gas current atmosphere at a reduction temperature of 1000° C. to 1200° C. for a time sufficient to reduce the surface oxide.

This reduction process requires a lot of hydrogen gas to be continuously supplied since dew point in the furnace rises as $H_2O$ is formed by the reaction with hydrogen gas. In the reduction furnace using hydrogen, there also involves a possibility of explosion. Therefore a great care must be taken in operation to avoid a possible explosion.

As a result of this reduction procedure, the finely divided particles tend to agglomerate and form a cake-like structure, thereby necessitating an additional grinding stage to brake up the cake and finally achieve the desired particle shape and size distibutions required for further compacting.

Oxides containing Ni and/or Mo can easily be reduced, however, oxides containing Mn and/or Cr can hardly be reduced by conventional reduction or annealing procedures since the oxides containing Mn and/or Cr have relatively low free energies.

SUMMARY OF THE INVENTION

It is therefore an object of the present invention to provide a novel reduction method of as-atomized ferrous metal particles, which is economical and safe in operation.

Another object of the present invention is to provide a process by which high quality powder metal preforms can be produced from economical particulate metals such as as-atomized ferrous metal powders.

It is still another object of the present invention to provide a process for the production of sintered powder ferrous metal preforms wherein as-atomized ferrous metal powders including manganese and/or chromium can be used.

In accordance with an aspect of the present invention, there is provided a method for reducing surface oxides of as-atomized ferrous metal powders comprising the steps of: heating said metal powders to a temperature of about 130° C. to 150° C.; coating said metal powders with thermoplastic phenol resins having an effective carbon content of 10 to 40 percent by adding said phenol resins to said metal powders, wherein said phenol resins are present from about 1.0 to 7.0 percent of the total mixture; cooling said resin coated metal powders by blowing cooling air thereto; and heating said resin coated metal powders to a temperature within the range of about 1100° C. to 1250° C. for a time sufficient to achieve reduction of said resin coated metal powders.

With this reducing method, as-atomized ferrous metal powders having surface oxides including Mn and/or Cr can easily be reduced, which are generally difficult to reduce by conventional methods.

According to another aspect of the present invention, there is provided a process for the production of sintered ferrous metal preforms employing the above mentioned reducing method.

As-atomized ferrous metal powders are coated with thermoplastic phenol resins having an effective carbon content of 10 to 40 percent by blending said phenol resins with said metal powders after heating said metal powders to about 130° C. to 150° C., wherein said phenol resins are present from about 1.0 to 7.0 percent of the total mixture. Said resin coated metal powders are cooled to a room temperature by blowing cooling air thereto and then filled in a mold and compacted under high pressure of about 3 to 5 tons/cm$^2$ to produce a compacted green preform sufficient to ensure adequate strength for handling after pressing. The green preform is then heated in an oxidation free atmospheric current to a reduction and sintering temperature within the range of about 1100° C. to 1250° C. for a time sufficient to achieve reduction of said green preform.

The above and other objects, features and advantages of the present invention will be readily apparent from the following description taken in conjunction with the accompanying drawings.

DETAILED DESCRIPTION OF THE INVENTION

Figure 1:
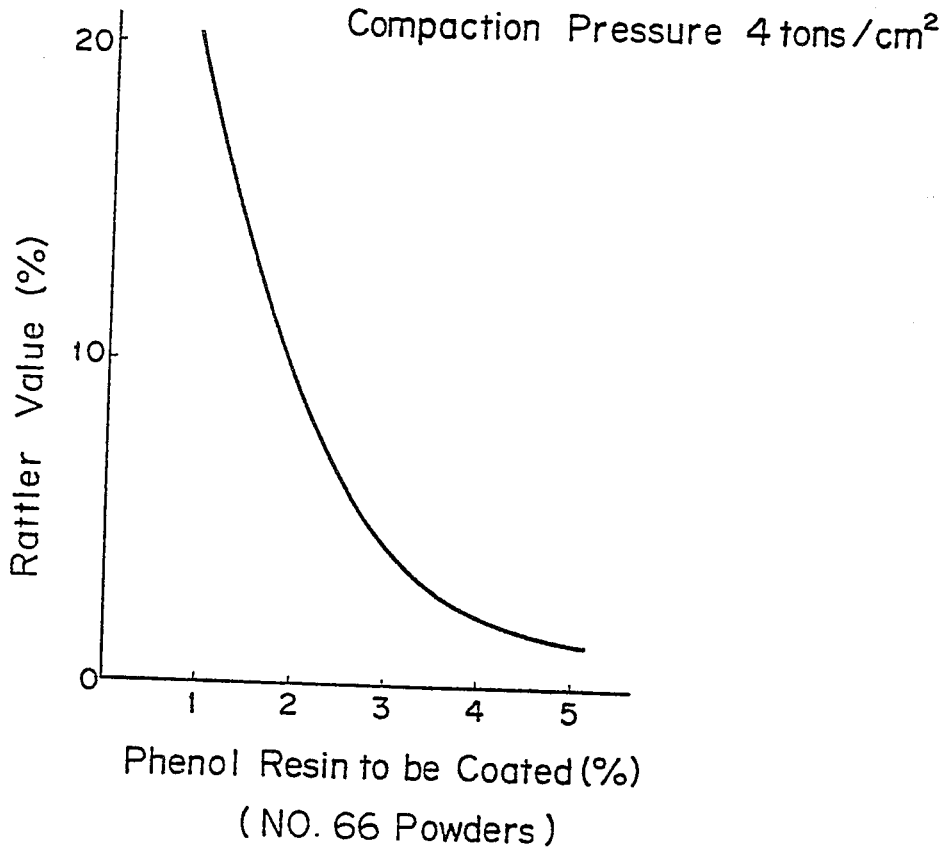
FIG. 1 is a graph showing a relationship between the amount of phenol resins to be added and the strength of compacted green preform.
Figure 2:
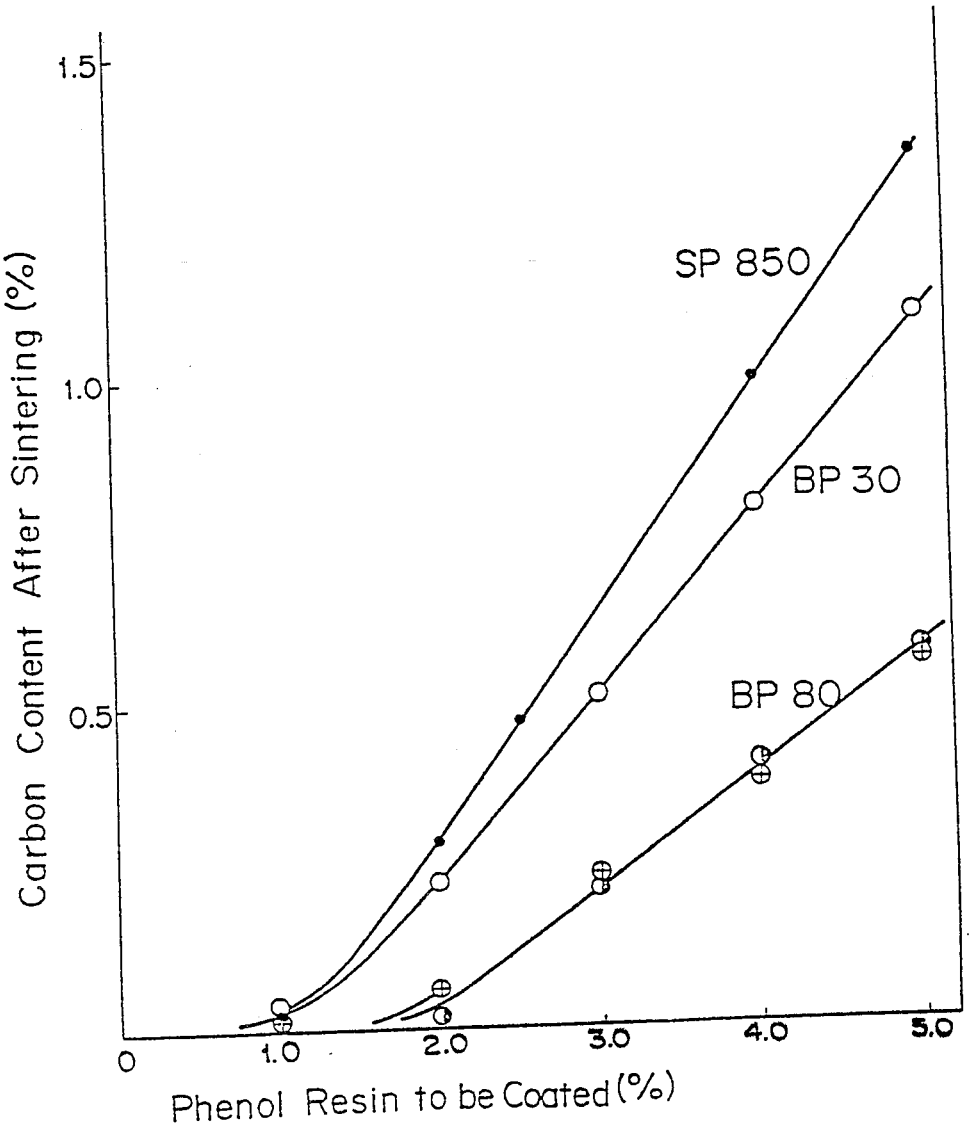
FIG. 2 is a graph showing a relationship between the amount of phenol resins to be added and the carbon contents of sintered preforms.

The present invention will now be described in detail with reference to the accompanying drawings. As-water-atomized ferrous metal powders or particles are used for the starting materials of the process.

The powders are coated with thermoplastic phenol resins by blending the phenol resins with the ferrous metal powders after heating said metal powders to a temperature from 130° C. to 150° C.

The phenol resins are to be added about 1.0 to 7.0% by weight in the total mixture. Preferably the phenol resins are present from about 2.5 to 3.5%. The resin coated ferrous metal powders are then cooled to a room temperature by blowing cooling air thereto while the powders are carried on belt conveyers. The resin coated powders are then introduced into a reduction furnace where phenol resins are decomposed by heat to produce gases such as $CH_2$, $H_2$. These gases are taken out from a stack of the furnace after burnt out.

It is recommended to introduce the resin coated powders initially into relatively low temperature regions of about 400° C. to 600° C. in the furnace for about 5 to 10 minutes and then introduce the powders into high temperature regions of about 1100° C. to 1250° C. where reduction of the oxides can be taken place in order to avoid emission of soot thereby protecting refractories of the furnace.

While passing through the low temperature regions, the phenol resins are decomposed to emit combustible gases.

The resin coated powders are maintained in the high temperature regions for a time sufficient to reduce surface oxides, which is about 30 to 120 minutes depending on oxygen content and other alloy-element contents. In the high temperature regions, residual carbon after decomposition will react with the surface oxides of the ferrous metal powders and reduction will proceed.

Nitrogen is used for furnace atmosphere and the sooner the gases generated from the following formula are taken out through the spacings of the powder aggregates, the sooner the reduction proceeds.

$$MO + C \rightarrow CO$$

$$MO + CO \rightarrow CO_2$$

Comparing with conventional reduction methods using a great amount of hydrogen for furnace atmosphere, the reduction method of the present invention has no fear of explosion and requires less amount of nitrogen to be used for furnace atmosphere thereby being able to reduce the running cost of the reduction process.

Since phenol resins to be coated not only act as reducing agent but have an effect to control residual carbon content of the reduced metal powders, residual carbon content of the sintered preforms can easily be controlled by changing the amount of phenol resins to be added, reduction time and reduction temperature. This feature is utilized for the production of sintered powder preforms as hereinafter described.

If phenol resins are merely admixed with metal powders, it is difficult to reduce the entire mixture uniformly due to inferior contacts therebetween, which is partly caused by separation of the mixture by difference in specific gravity and dispersion of phenol resin powders from the mixture.

On the other hand, however, if metal powders are coated with phenol resins, the above noted drawbacks can be overcome and phenol resins can be intimately contacted with surface oxides of metal powders thereby providing an efficient and uniform reduction of the entire mixture.

In the water atomization method, since molten steel is atomized by high pressure and high velocity water jet and is simultaneously cooled rapidly, the form of atomized powders is irregular and complicated.

Therefore total surface area of atomized powders becomes large and it is necessary to permeate phenol resins deep into the complicated surfaces of the atomized metal powders to intimately contact therewith in order to reduce surface oxides deposited on buttom surface portions of the powders.

The coating method as disclosed herein is, therefore, the most efficient method to intimately contact phenol resins with metal powders.

In addition to the reduction method in hydrogen atmosphere, there have been proposed two different reduction methods; namely, a reduction method using solute carbon and a method admixing graphite with metal powders both in an oxidation free atmosphere.

In the former, it takes a long time to reduce the surface oxides due to relatively slow outward diffusion speed of the solute carbon and it is necessary to control the amount of carbon to be added at the melting.

In the latter, graphite powders are likely to segregate due to difference in specific gravity and this method is less effective to reduce the mixture uniformly.

Coating metal powders with graphite has also been proposed, however, this is not as easy as coating metal powders with phenol resins and impractical due to expensive running cost involved.

There are two methods for producing resin coated metal powders, a cold method and dry hot method. The cold method is a method wherein phenol resins are melted by methanol and after coating methanol is evaporated. But this method has a pollution problem because it emitts stimulative gases and the mixture is likely to become block-like form in the process of coating. In the dry hot method, ferrous metal powders are heated to a temperature from about 130° C. to 150° C. in a mixing machine and admixed with phenol resins (flake shape or needle shape) added. After blending for about one minute at the elevated temperature metal powders are uniformly coated with phenol resins and then resin coated powders are cooled by blowing cooling air thereto on a continuous conveyor belt. Cooled resin coated powders are graded by passing them through sieves. This hot dry method is economical and free from pollution and therefore adapted to industrial use.

Thermoplastic phenol resins are especially adapted for the present invention.

Thermosetting phenol resins are generally not suited for the present invention because residual carbon contents of these resins are about 55% and considered to be too high as hereinafter explained and also because setting speed for the coating is too fast to treat effectively. In thermoplastic phenol resins, however, residual carbon contents can be lowered less than 40% by changing degree of polymerization and coating is easily carried out due to slow setting speed.

Further when using thermoplastic phenol resins, it is advantageous for baking under low temperatures, which improves rattler values after compaction of the resin coated powders.

Phenol resin useful for the present invention has following general formula.

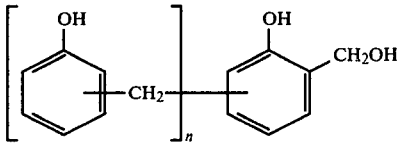

Degree of polymerization of the above compound is no greater than 10 and amount of phenol resins to be added can be controlled by changing degree of polymerization.

Three different types of phenol resins were used for the experiments of the invention, namely BP80, BP30 and SP85. Degree of polymerization for BP80 is 1 or 2, BP30 is 2 or 3 and SP85 is 3 or 4, respectively, and residual carbon content after decomposition is about 20%, 30% and 40%, respectively.

When sintering and reducing compacted resin coated powders, cracks and/or deformation may occur due to gas generation if phenol resins are added to much.

On the other hand, however, if addition of phenol resins are too little, bonding strength and lubrication will be lowered.

Therefore it is desired that phenol resins be added from about 1.0% to 7.0%, preferably from about 2.0 to 5.0 and most preferably from about 2.5 to 3.5% of the total mixture.

As-atomized ferrous metal powders containing Mn and/or Cr can effectively be reduced by this reduction method, which alloy powders have been considered to be difficult to reduce by conventional reduction methods. Residual oxygen content can be reduced to about 200–300 ppm for one hour reduction at the temperature of 1200° C. in the case of as-atomized ferrous metal powders containing Mn and/or Cr.

Reduction sintering method of the present invention will be explained hereinafter. Reduction sintering as used herein is a method wherein sintering and reduction take place at the same time. Before performing reduction sintering, resin coated ferrous metal powders must be compacted in a mold under a pressure of from about 3 to 5 tons/cm$^2$ to obtain a compacted green preform.

Referring to FIG. 1, rattler value of compacted green preform will improve as the amount of phenol resins to be added and coated will increase. Rattler value as used herein indicates brittleness of compacted green preform.

Compacted green preform is then heated in an oxidation free atmospheric current to a temperature of about 1100° C. to 1250° C. for a time sufficient to achieve reduction and sintering of the green preform.

Reduction sintering time depends on oxygen content to be reduced and types of alloy elements included in the water atomized ferrous metal powders.

Tables I and II show chemical compositions and powder characteristics of water atomized Mn-Cr-Mo ferrous metal powders, respectively.

Table III shows types of phenol resins to be added, each having residual carbon content after decomposition of 20%, 30% and 40%, respectively. By changing the amount of and types of phenol resins to be added, it is possible to obtain a sintered preform having a required residual carbon content.

TABLE I

| | Chemical Composition of As-atomized Powders | | | | | | | | | | |
|---|---|---|---|---|---|---|---|---|---|---|---|
| | Components (wt %) | | | | | | | | | | D.I.Value |
| | C | Si | Mn | Mo | Ni | Cr | Al | $O_2$ | S | P | (C = 0.2) |
| No. 65 | 0.02 | 0.002 | 0.67 | 0.45 | 1.74 | 0.18 | — | 0.5 | 0.005 | 0.006 | 3.35 |
| No. 66 | 0.03 | 0.023 | 0.74 | 0.23 | — | 0.81 | <0.01 | 0.72 | 0.008 | 0.005 | 2.43 |

TABLE II

| | Powder Characteristics | | |
|---|---|---|---|
| | Grain Size (%) | Apparent Density | Fluidity |
| No. 66 | +80 150,200,325 −325<br>0.3% 13 ~ 16% each 41% | 3.01 | 24.4 |

TABLE III

| Types of Phenol Resins | |
|---|---|
| Resin Type | Residual Carbon |
| BP 80 | 20% |
| BP 30 | 30% |
| SP850 | 40% |

Figure 3:
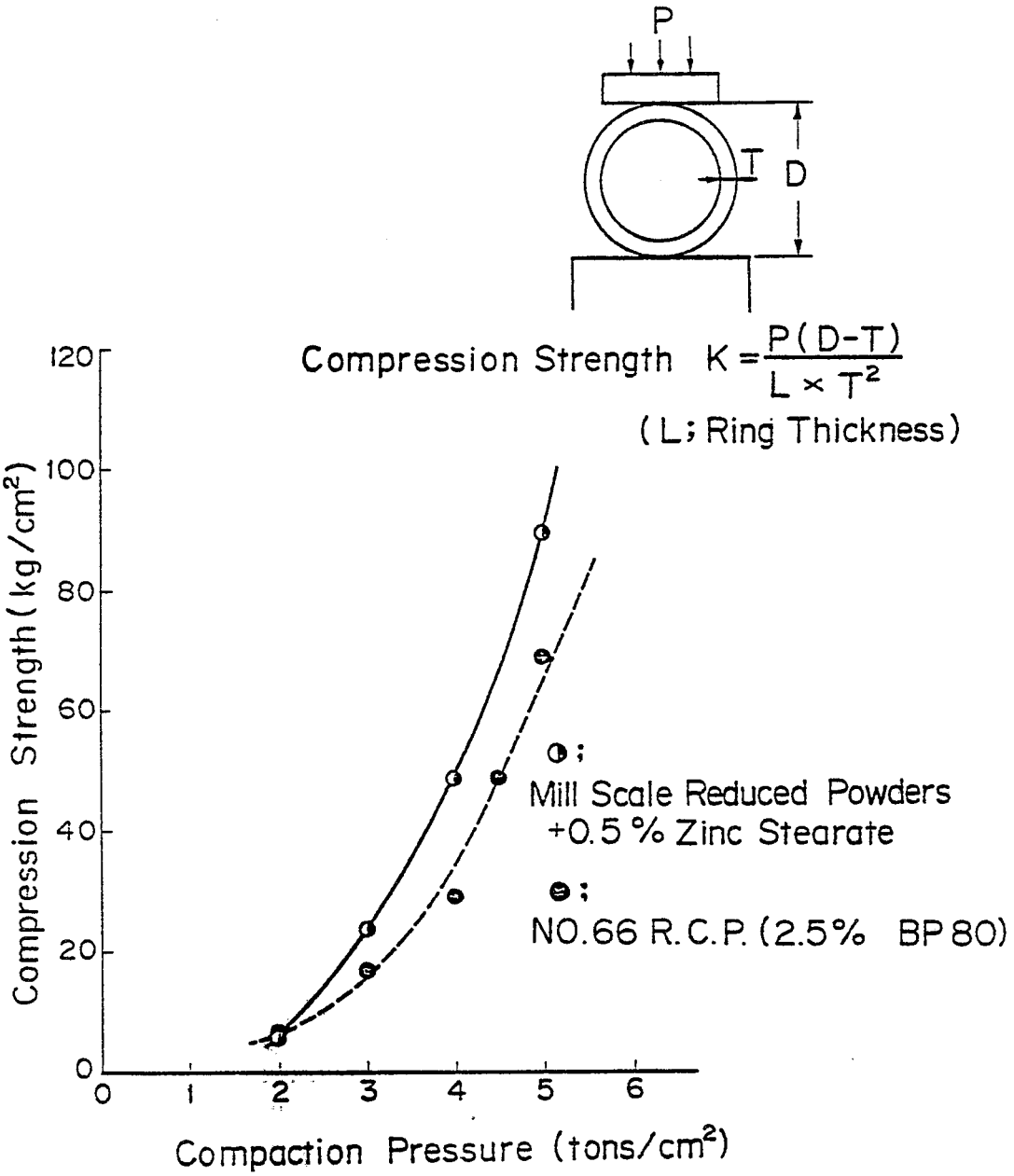
FIG. 3 is a graph showing a relationship between the compaction pressure to be applied and the compression strength of a ring made of compacted green preform.

Referring to FIG. 3 which shows a relationship between the compaction pressure to be applied and the compression strength of a ring made of compacted green preform, the compaction strength of a ring according to the present invention is not so inferior to that of a ring made of a conventional process using reduced metal powders.

Figure 4:
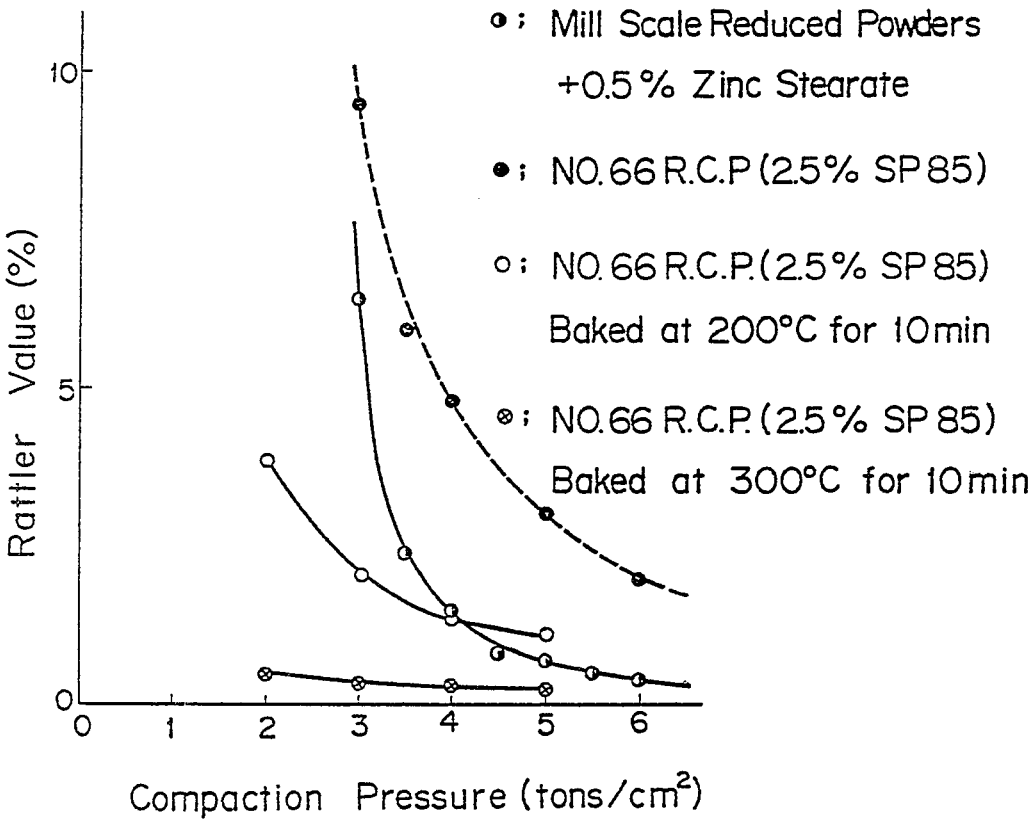
FIG. 4 is a graph showing a relationship between the compaction pressure to be applied and the rattler value of compacted green preforms of non-reduced phenol resin coated ferrous metal powders of the present invention in comparison with reduced mill scale powders.

Referring to FIG. 4, the rattler values of compacted green preforms of the present invention are higher than those of green preforms made by a conventional process. It has been confirmed, however, that the handling strength of green preforms compacted by 5 tons/cm$^2$ and having rattler value 3.0% is good enough for practical use.

Further, high rattler values of green preforms are not a big problem since green preforms can easily be deformed and, cut at the corners.

When it is required to improve or lower rattler values, resin coated powders can be baked at an elevated temperature of 200° C. to 300° C.

Figure 5:
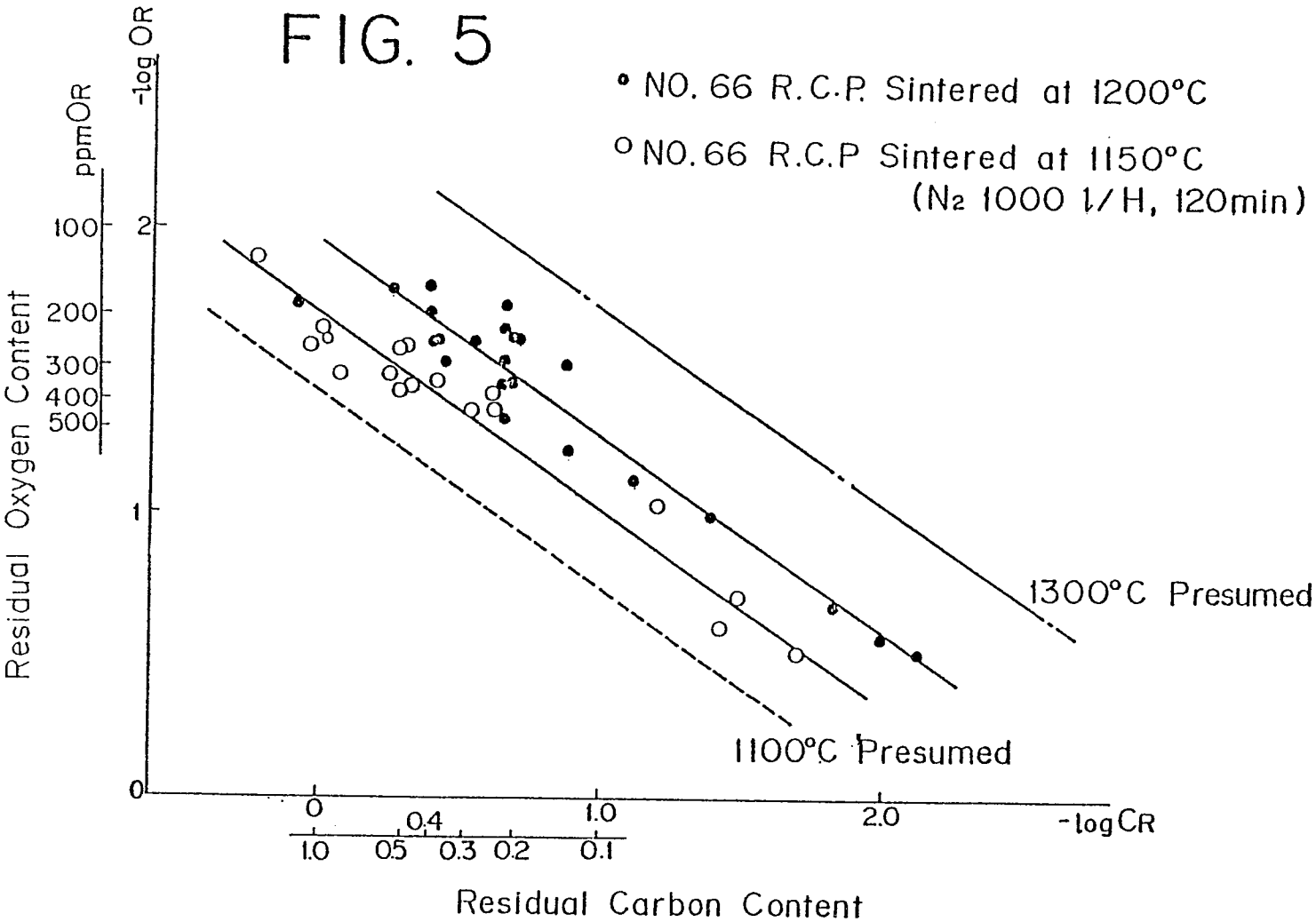
FIG. 5 is a graph showing a relationship between residual carbon content and residual oxygen content in the sintered preforms.

Referring to FIG. 5, it can be seen that the residual oxygen content can be reduced up to 200 ppm when residual carbon content is controlled to 0.2% in case of case hardening steel.

Figure 6:
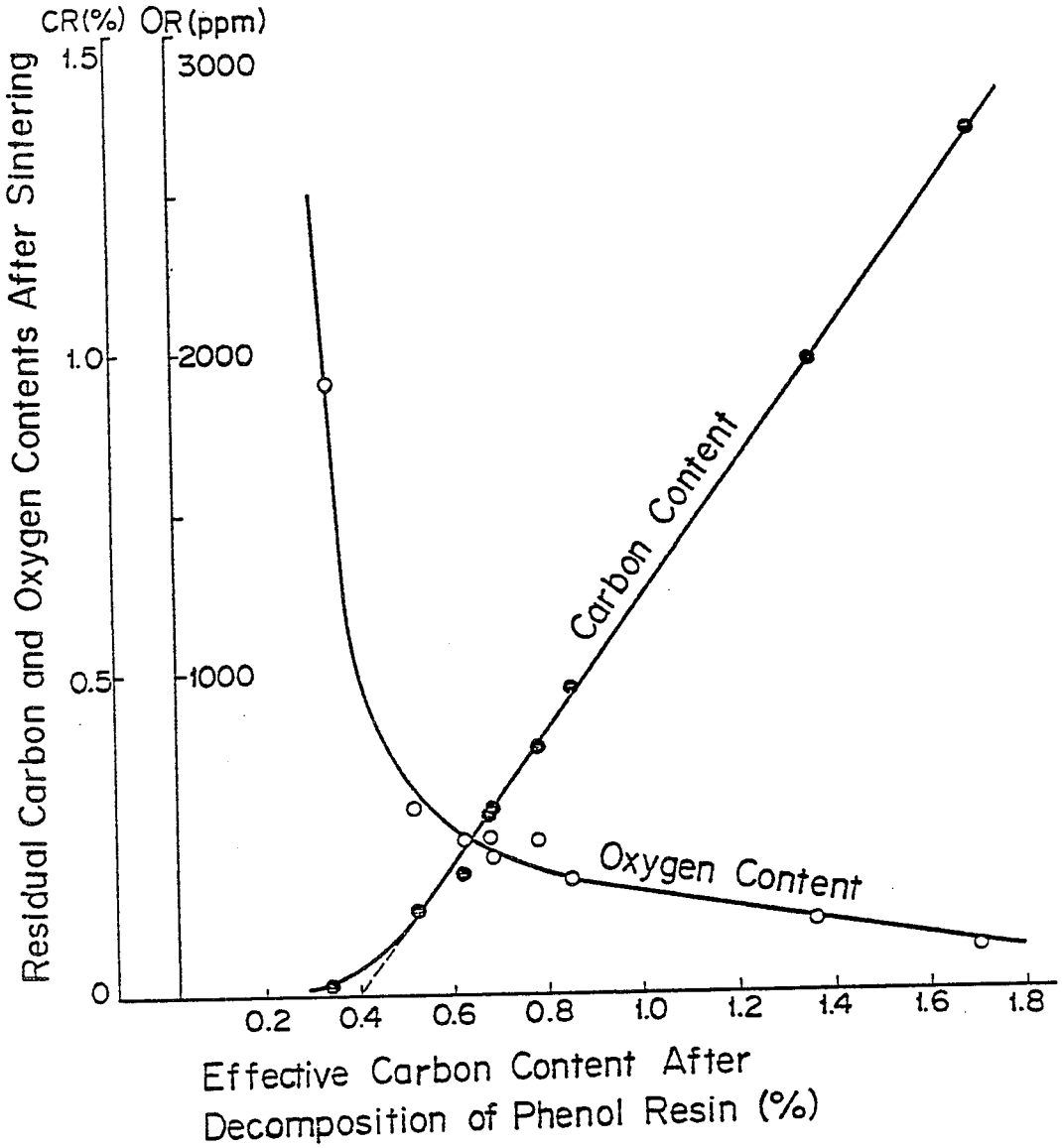
FIG. 6 is a graph showing a relationship between effective carbon contents of phenol resins after decomposition and residual carbon and oxygen contents of the sintered preforms.

Referring to FIG. 6 it can be seen that the initial oxygen content of 7200 ppm is rapidly reduced as increase of phenol resins to be added. When effective carbon content exceeds 0.4%, carbon content in the sintered preforms increases in proportion to an increase of effective carbon contents. This is because excess amounts of carbon which are not used for reducing oxygen will melt in the solid solution.

Figure 7:
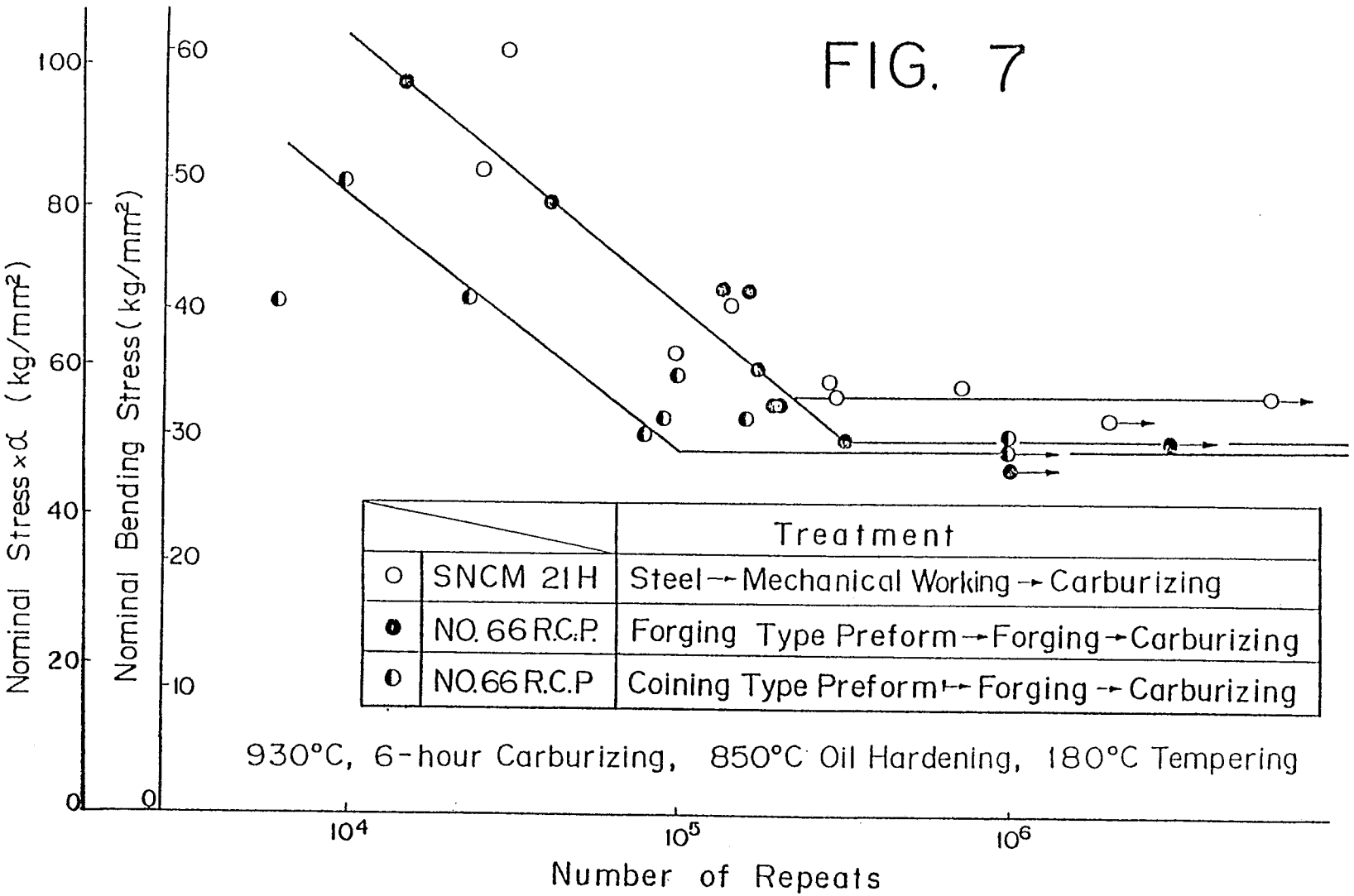
FIG. 7 is a graph showing a S-N diagram of a steel and sinter forged metals.
Figure 8:
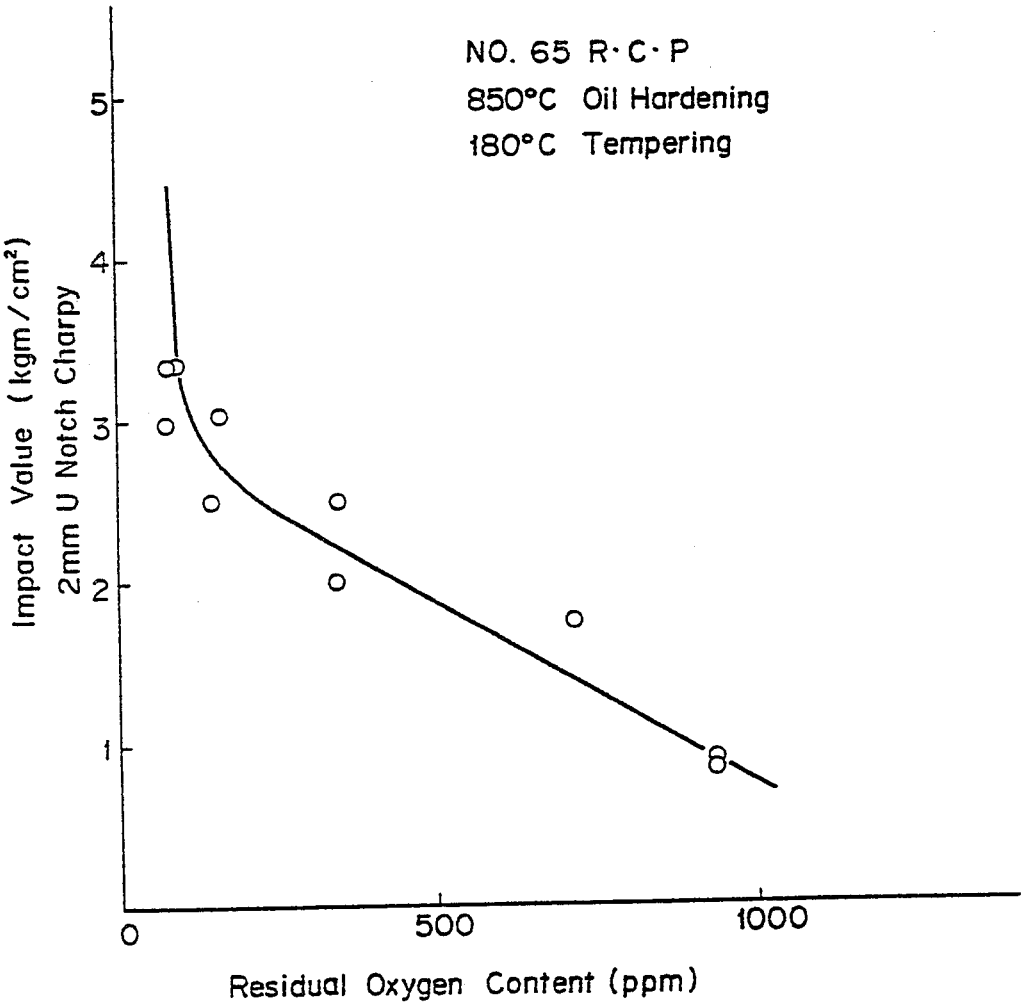
FIG. 8 is a graph showing a relationship between residual oxygen contents and impact values of forged sintered metals.
Figure 9:
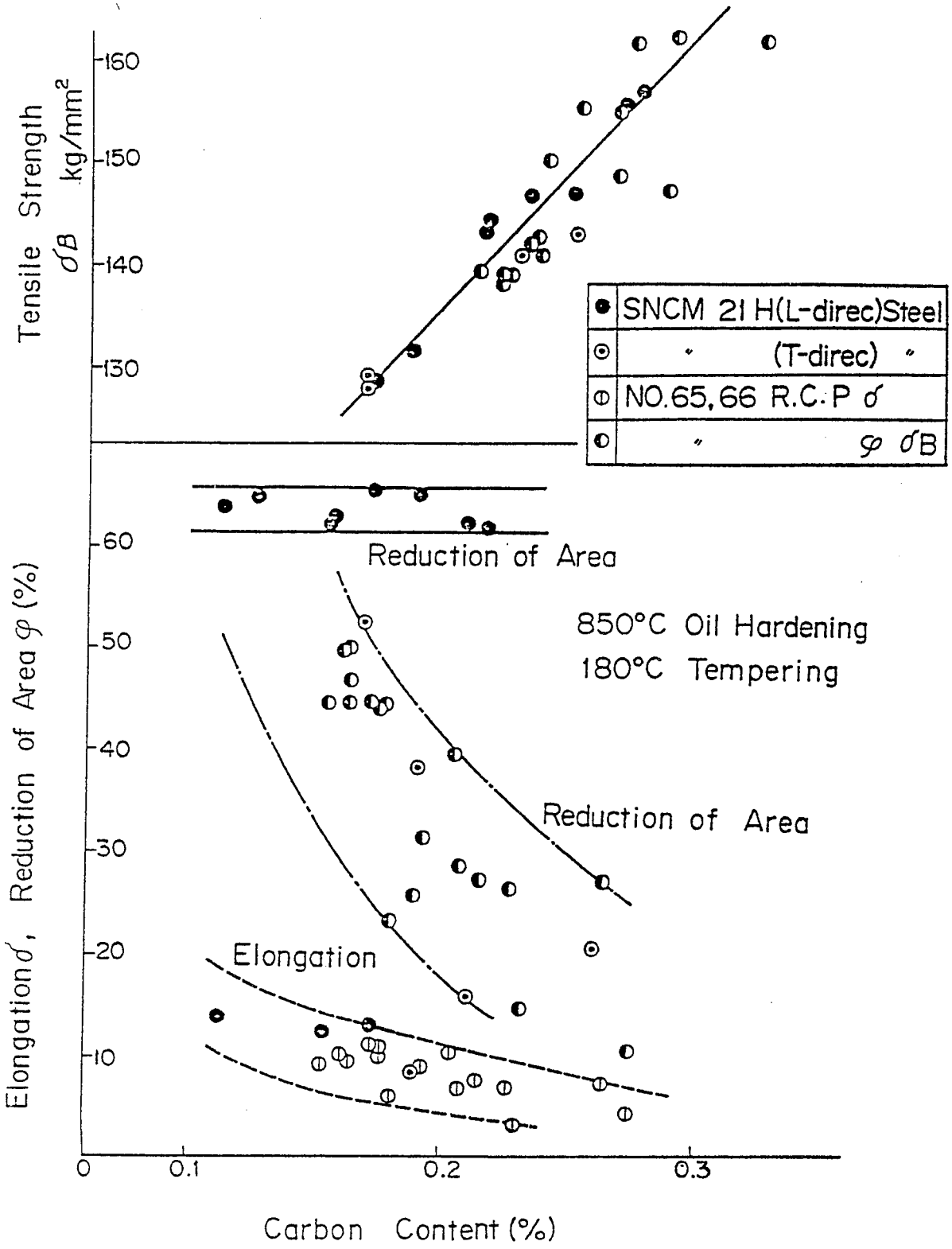
FIG. 9 is a graph showing a relationship between carbon content and tensile strength $\sigma_B$, elongation $\delta$ and reduction of area $\phi$.

Mechanical properties of forged preforms are shown in FIGS. 7, 8 and 9 wherein resin coated powders were compacted under the pressure of 3 tons/cm$^2$ and then sintered at the temperature of 1200° C. Sintered preforms were cooled to a room temperature and hot forged under the pressure of 10 to 12 tons/cm$^2$ after reheating them to 900° C. in nitrogen current atmosphere.

Forged preforms were then carburized or quenched and tempered.

FIG. 7 is a graph showing a fatigue test comparing a forged test piece produced by the present invention with a steel of SNCM21H (JIS).

No. 66 ferrous metal powders were coated with 2.5% BP850 phenol resin, and resultant resin coated powders were sintered and forged to produce the test piece.

It is apparent from the figure that the degree of fatigue of the test piece produced by the present invention is slightly inferior to that of SNCM21H but good enough to meet the practical use.

Referring to FIG. 8, it can be seen that impact values of forged sintered metals of the present invention drastically increase when residual oxygen content becomes less than 200 ppm.

Referring to FIG. 9, it can be seen that tensile strength $\sigma_B$ and elongation $\delta$ of the sintered material of the present invention are almost same as those of SNCM21H produced by melting but reduction of area $\phi$ of sintered material of the present invention is inferior to that of SNCM21H.

Referring back to FIG. 6, the amount of phenol resins to be added should be sufficient enough to increase the residual carbon content in the sintered preform at least 0.05 wt % because if the phenol resins are added less than this value, the residual oxygen content will be drastically increased.

As described hereinabove, phenol resins coated not only function as lubricant between ferrous metal powders but function as binders therebetween and compacted green preforms with sufficient handling strength and dimension accuracy can be produced. Further the present invention does not require a step for removing lubricant at about 600° C. by evaporating it, which is normally required in conventional sintering processes.

Since as-sintered materials produced by the present invention have good dimension accuracy, they can be adopted in practical use without being further processed. Sintered materials are, of course, adapted to be forged to produce stronger parts.

What is claimed is:

1. A method for the production of sintered powder ferrous metal preforms comprising the steps of; heating said ferrous metal particles to a temperature of about 130° C. to 150° C.;

coating finely divided ferrous metal particles with thermoplastic phenol resins having an effective carbon content of 10 to 40 percent by adding said phenol resins to said ferrous metal particles, wherein said phenol resins are present from about 1.0 to 7.0 percent of the total mixture;

cooling said resin coated ferrous metal particles by blowing cooling air thereto;

packing a mold with said resin coated ferrous metal particles;

compacting said resin coated ferrous metal particles in the mold by applying pressure of 3 to 5 tons/cm$^2$ thereon to produce a compacted green preform sufficient to ensure adequate strength for handling after pressing; and heating said green preform in an oxidation free atomospheric current to a temperature within the range of about 1100° C. to 1250° C. for a time sufficient to achieve reduction and sintering of said green preform.

2. The method as defined in claim 1 wherein said thermoplastic phenol resins are present in an amount sufficient to increase the carbon content by a value greater than 0.5 percent.

3. The method as defined in claims 1 or 2 wherein said phenol resins comprise three different types each having an effective carbon content or residual carbon content after decomposition of 20%, 30% and 40% by weight, respectively, and wherein carburizing of said ferrous metal particles after reduction can be adjusted by controlling the amount of and/or types of phenol resins to be used.

4. The method as defined in claim 1 wherein said phenol resins are present from about 2.0 to 5.0 percent of the total mixture.

5. The method as defined in claims 1 or 4 wherein said ferrous metal particles are as-water-atomized and include chromium and/or manganese as alloy element as well as carbon reducible oxygen.

* * * * *